United States Patent [19]

Kawanabe et al.

[11] Patent Number: 4,763,265

[45] Date of Patent: Aug. 9, 1988

[54] AIR INTAKE SIDE SECONDARY AIR SUPPLY SYSTEM FOR AN INTERNAL COMBUSTION ENGINE WITH AN IMPROVED DUTY RATIO CONTROL OPERATION

[75] Inventors: Tomohiko Kawanabe, Utsunomiya; Masahiko Asakura, Tokorozawa; Noritaka Kushida, Tokyo; Yasunari Seki; Takanori Shiina, both of Utsunomiya; Minoru Muroya, Wako, all of Japan

[73] Assignee: Honda Giken Kogyo Kabushiki Kaisha, Tokyo, Japan

[21] Appl. No.: 826,467

[22] Filed: Feb. 5, 1986

[30] Foreign Application Priority Data

Apr. 16, 1985 [JP] Japan ..... 60-081174
Apr. 16, 1985 [JP] Japan ..... 60-081175

[51] Int. Cl.[4] ..... F02B 3/00

[52] U.S. Cl. ..... 364/431.04; 364/431.05; 123/589

[58] Field of Search ..... 364/431.04, 431.05; 123/489, 440, 589

[56] References Cited

U.S. PATENT DOCUMENTS 4,129,105 12/1978 Ito et al. ..... 123/589
4,173,957 11/1979 Hattori et al. ..... 123/589
4,271,667 6/1981 Mitsuda et al. ..... 123/589
4,290,107 9/1981 Suda et al. ..... 123/589
4,408,584 10/1983 Yabuhara et al. ..... 123/440
4,459,669 7/1984 Chujo et al. ..... 364/431.05

FOREIGN PATENT DOCUMENTS 0000348 1/1982 Japan ..... 123/589

*Primary Examiner*—Parshotam S. Lall
*Attorney, Agent, or Firm*—Pollock, VandeSande & Priddy

[57] ABSTRACT

An air intake side secondary air supply system for an internal combustion engine having an air intake side secondary air supply system includes an oxygen concentration sensor, and controls a duty ratio of opening and closing of an open/close valve disposed in the air intake side secondary air supply passage by determining a valve open period within each duty cycle of control operation in accordance with a result of comparison between the level of the output signal of the oxygen concentration sensor and a level corresponding to a target air-fuel ratio. The duty ratio of opening and closing of the open/close valve is maintained within a predetermined duty ratio range so as to improve effectiveness of the control of the secondary air supply as well as to avoid the generation of over lean or over rich mixture.

6 Claims, 6 Drawing Sheets

AIR INTAKE SIDE SECONDARY AIR SUPPLY SYSTEM FOR AN INTERNAL COMBUSTION ENGINE WITH AN IMPROVED DUTY RATIO CONTROL OPERATION

BACKGROUND OF THE INVENTION

1. Field of the Invention

The present invention relates to an air intake side secondary air supply system for an internal combustion engine, and more particularly to a system which performs a duty ratio control of an open/close valve disposed in an air intake side secondary air supply passage.

2. Description of Background Information

Air-fuel ratio feedback control systems for an internal combustion engine are well known as systems in which oxygen concentration in the exhaust gas of the engine is detected by an oxygen concentration sensor (referred to as an $O_2$ sensor hereinafter) and the air-fuel ratio of the mixture to be supplied to the engine is feedback controlled in response to an output signal level of the $O_2$ sensor for the purification of the exhaust gas and for improvements of the fuel economy. As an example of the air-fuel ratio feedback control system, an air-intake side secondary air supply system for the feedback control is proposed, for example, in Japanese Patent Publication No. 55-3533. In this air intake side secondary air supply system, an open/close valve is disposed in an air intake side secondary air supply passage which communicates with the carburetor on the downstream side of the throttle valve; and the open/close valve is on-off controlled in response to the output signal level of the $O_2$ sensor, so as to effect a "duty ratio control" of the supply of the air intake side secondary air. In conventional air intake side secondary air supply systems as described above, whether the air-fuel ratio of the mixture supplied to the engine is rich or lean with respect to a target air-fuel ratio is determined from an output signal level of the $O_2$ sensor. The control of the open/close valve is performed in such a manner that a base valve open time within each duty cycle is decreased by a predetermined amount when a result of detection of air-fuel ratio is "lean". On the other hand, if the result of detection is "rich", the base valve open time period is increased by a predetermined amount. Then, a calculated value obtained by the integration operation described above is set as an output valve open period in which the open/close valve is opened, every cycle of the duty ratio control. In another case an amount of the correction value to be added to the base valve open period for the integration operation is decreased by a predetermined amount when the result of detection is "lean", and the amount of the correction value is increased by a predetermined amount when the result of detection is "rich". Then the correction value is added to the base valve open period, to produce the output valve open period.

With this type of conventional air intake side secondary air supply system, if the air-fuel ratio of the mixture supplied to the engine fluctuates wildly from the target air-fuel ratio due to a reason such as a rapid change in the engine operation, the duty ratio of the opening of the open/close valve was controlled over a wide range into a low end region (0–20% for example) or a high end region (90–100% for example).

However, in the case of usual open/close valves used for controlling the air flow, as shown in FIG. 1, the change in the amount of air flowing through the open/close valve will become very slight with respect to the change in the duty ratio in the low end part or in the high end part of the duty ratio. Therefore, to control the duty ratio of the supply of the air intake side secondary air over a wide range into the low end region or the high end part of the duty ratio, which was the case in the conventional design, is inefficient. Further, when the duty ratio of the supply of the air intake side secondary air is controlled into the high end region (90–100% for example), the air-fuel ratio of the mixture becomes over-lean, which in turn causes the deterioration of the driveability, and further the misfire of the ignition system.

Moreover, in the event that the $O_2$ sensor fails, the output signal level of the $O_2$ sensor will become saturated, as a result, the duty ratio of the opening and the closing of the open/close valve will stay around the value of 0% or 100%. In such case, the operation of the open/close valve during the feedback control operation of the air-fuel ratio will be stopped thereby setting the system out of control. As a result the air-fuel ratio is greatly differed from the target air-fuel ratio.

OBJECT AND SUMMARY OF THE INVENTION

An object of the present invention is to provide an air intake side secondary air supply system for an internal combustion engine, in which the width of the control of the duty ratio is limited to a range where the amount of the air, intake side secondary air varies continuously to prevent the deterioration of the driveability as well as the misfire due to an over lean mixture, and in which an abnormality of air-fuel ratio control is avoided even if the $O_2$ sensor fails.

According to the present invention, an air intake side secondary air supply system inhibits the opening of the open/close valve over a maximum limit of opening time when the calculated output valve open period is longer than the maximum limit of opening time. Thus, under such a condition, the opening time of the open/close valve is controlled so that it does not exceed the maximum limit of opening time. On the other hand, if the calculated output valve open period is shorter than a minimum limit of opening time, the open/close valve is opened for the minimum limit of opening time, to secure a minimum supply of the air intake side secondary air.

According to another aspect of the invention, in addition to the above operation, the correction value is made equal to a first standard value when the calculated output valve open period is longer than the maximum limit of valve open period, and the correction value is made equal to a second standard value when the calculated output valve open period is shorter than the minimum limit of valve open period.

BRIEF DESCRIPTION OF THE DRAWINGS

FIGS. 5 and 6 are flowcharts showing the manner of operation of a CPU 29 in the control circuit 20, of which FIG. 6 shows the A/F routine for calculating the correction value $I_{out}$;

DETAILED DESCRIPTION OF THE INVENTION

Referring to FIGS. 2 through 8 of the accompanying drawings, the embodiment of the air intake side secondary air supply system according to the present invention will be explained hereinafter.

Figure 2:
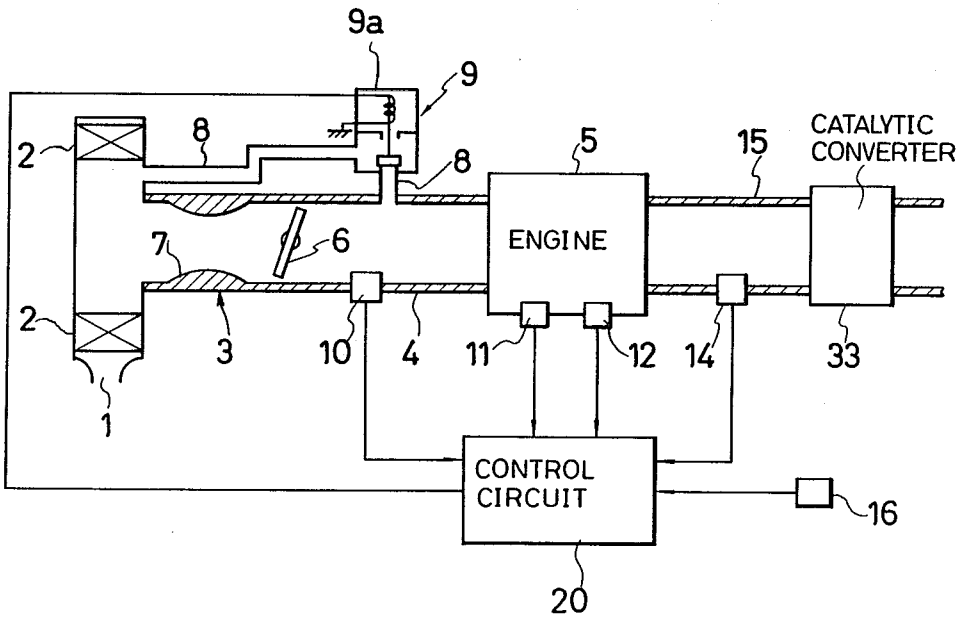
FIG. 2 is a schematic diagram showing a general construction of the system according to the invention.

In FIG. 2 which illustrates the embodiment of the air intake side secondary air supply system, an intake air taken at an air inlet port 1 is supplied to an internal combustion engine 5 through an air cleaner 2, a carburetor 3, and an intake manifold 4. The carburetor 3 is provided with a throttle valve 6 and a venturi 7 on the upstream side of the throttle valve 6. The inside of the air cleaner 2, near an air outlet port, communicates with the intake manifold 4 via an air intake side secondary air supply passage 8. The air intake side secondary air supply passage 8 is provided with an open/close solenoid valve 9. The open/close solenoid valve 9 is designed to open when a drive current is supplied to a solenoid 9*a* thereof.

The system also includes an absolute pressure sensor 10 which is provided in the intake manifold 4 for producing an output signal whose level corresponds to an absolute pressure within the intake manifold 4, a crank angle sensor 11 which produces pulse signals in response to the revolution of an engine crankshaft (not shown), an engine cooling water temperature sensor 12 which produces an output signal whose level corresponds to the temperature of engine cooling water, and a lean oxygen concentration sensor 14 which is provided in an exhaust manifold 15 of the engine for generating an output signal whose level varies in proportion to an oxygen concentration in the exhaust gas.

Figure 1:
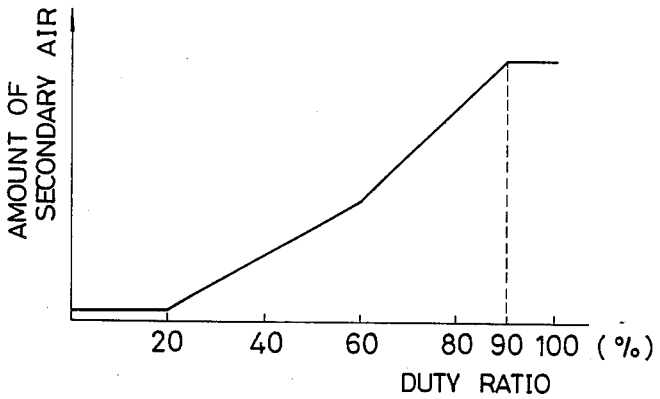
FIG. 1 is a graph showing a relation between the duty ratio of the opening of the open/close valve and the amount of the secondary air.
Figure 3:
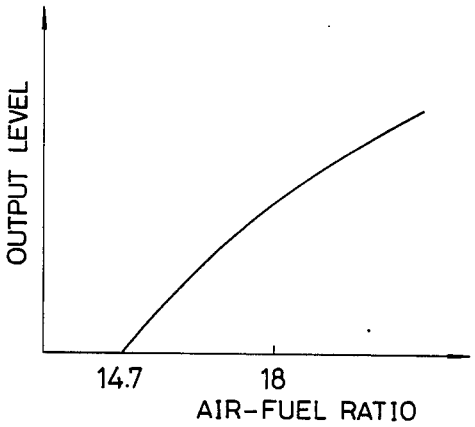
FIG. 3 is a graph showing a signal output characteristic of the oxygen concentration sensor 14 used in the system of FIG. 2.

FIG. 3 shows a signal output characteristic of the oxygen concentration sensor 14. As shown, the output signal level of the oxygen concentration sensor increases proportionally as the air-fuel ratio of the mixture becomes leaner from a stoichiometric air-fuel ratio value. Further, a catalytic converter 33 for accelerating the reduction of the noxious components in the exhaust gas is provided in the exhaust manifold 15 at a location on the downstream side of the position of the oxygen concentration sensor 14. The open/close solenoid valve 9, the absolute pressure sensor 10, the crank angle sensor 11, the engine cooling water temperature sensor 12, and the oxygen concentration sensor 14 are electrically connected to a control circuit 20. Further, a vehicle speed sensor 16 for producing an output signal whose level is proportional to the speed of the vehicle is electrically connected to the control circuit 20.

Figure 4:
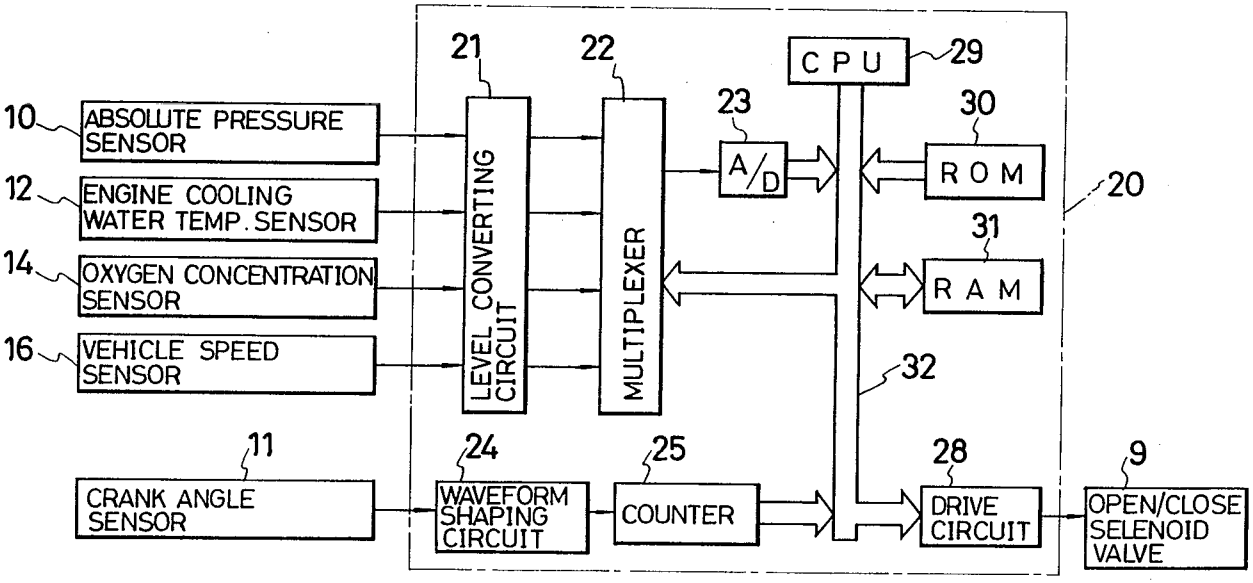
FIG. 4 is a block diagram showing the construction of the control circuit 20 of the system of FIG. 2.

FIG. 4 shows the construction of the control circuit 20. As shown, the control circuit 20 includes a level converting circuit 21 which effects a level conversion of the output signals of the absolute pressure sensor 10, the engine cooling water temperature sensor 12, the oxygen concentration sensor 14, and the vehicle speed sensor 16. Output signals provided from the level converting circuit 21 are in turn supplied to a multiplexer 22 which selectively outputs one of the output signals from each sensor passed through the level converting circuit 21. The output signal provided by the multiplexer 22 is then supplied to an A/D converter in which the input signal is converted into a digital signal. The control circuit 20 further includes a waveform shaping circuit 24 which effects a waveform shaping of the output signal of the crank angle sensor 11, to provide TDC signals in the form of pulse signals. The TDC signals from the waveform shaping circuit 24 are in turn supplied to a counter 25 which counts intervals of the TDC signals. The control circuit 20 includes a drive circuit 28 for driving the open/close solenoid valve 9 in an opening direction, a CPU (central processing unit) 29 which performs digital operations according to various programs, a ROM in which various operating programs and data have been previously stored, and a RAM 31. The multiplexer 22, the A/D converter 23, the counter 25, the drive circuit 28, the CPU 29, the ROM 30, and the RAM 31 are mutually connected via an input/output bus 32.

In the thus constructed control circuit 20, information of the absolute pressure in the intake manifold 4, the engine cooling water temperature, the oxygen concentration in the exhaust gas, and the vehicle speed is selectively supplied from the A/D converter 23, to the CPU 29 via the input/output bus 32. Also, information indicative of the engine speed is supplied from the counter 25 to the CPU 29 via the input/output bus 32. The CPU 29 is constructed to generate an internal interruption signal every one duty period $T_{SOL}$ (100 m sec, for instance). In response to this internal interruption signal, the CPU 29 performs an operation for the duty ratio control of the air intake side secondary air supply, explained hereinafter.

Figure 5:
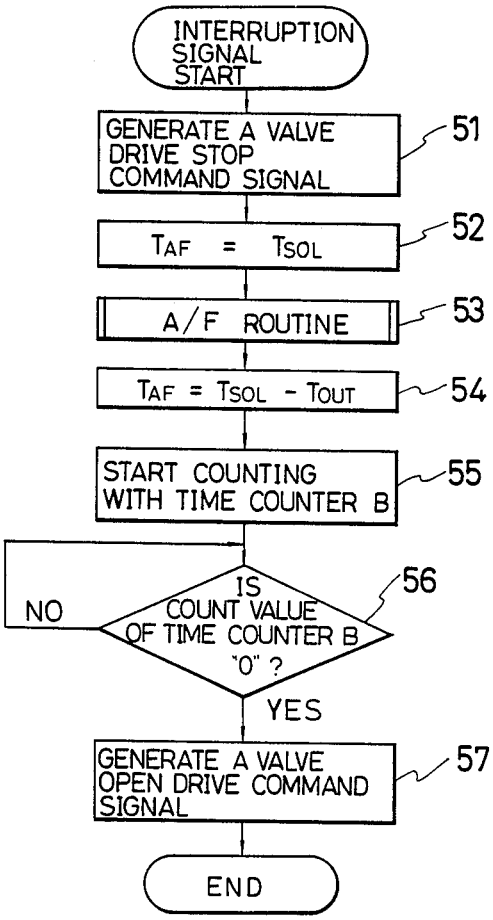
Figure 6:
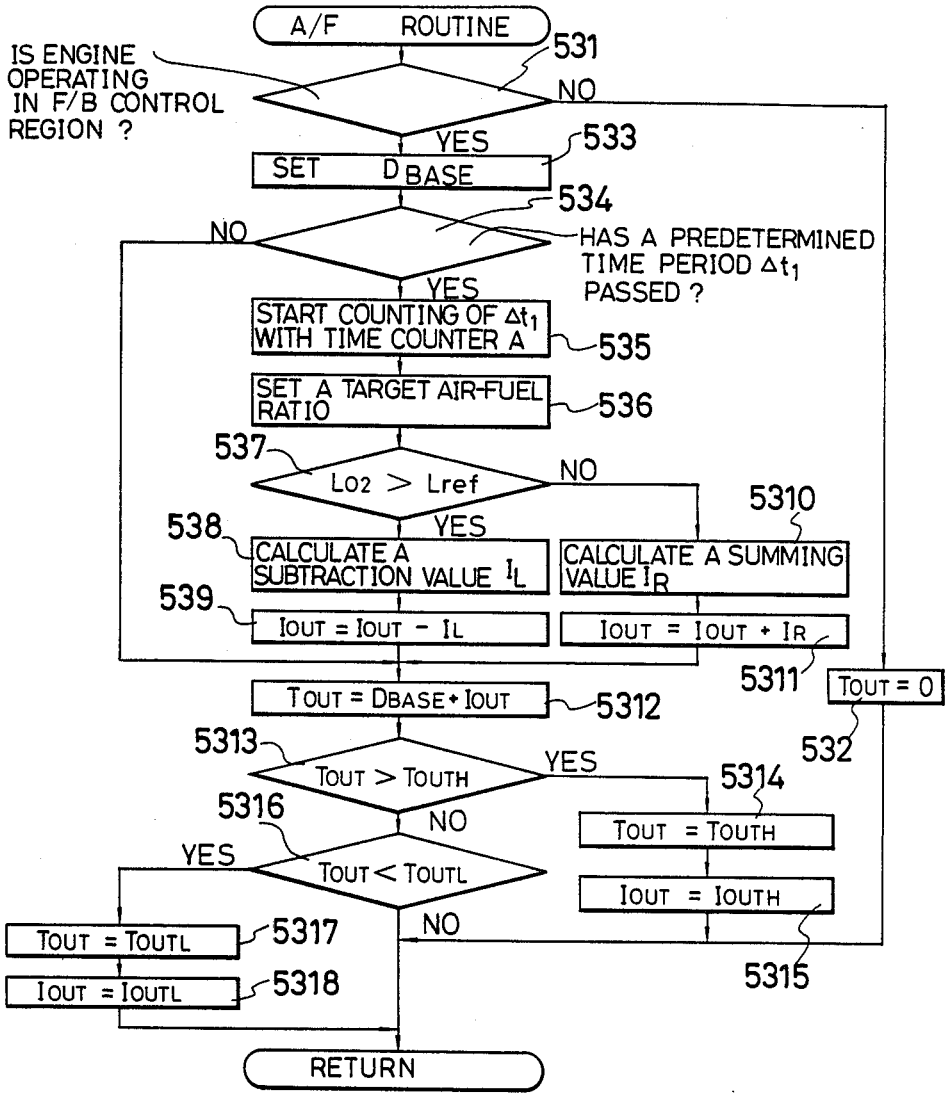

Referring to the flowcharts of FIGS. 5 and 6, the operation of the air intake side secondary air supply system according to the present invention will be explained hereinafter.

At a step 51, a valve open drive stop command signal is generated in the CPU 29 and supplied to the drive circuit 28, each time an internal interruption signal is generated in the CPU 29. With this signal, the drive circuit 28 is controlled to close the open/close solenoid valve 9. This operation is provided so as to prevent malfunctions of the open/close solenoid valve 9 during the calculating operation of the CPU 29. Next, a valve close period $T_{AF}$ of the open/close solenoid valve 9 is made equal to a period of one duty cycle $T_{SOL}$ at step 52; and an A/F routine for calculating a valve open period $T_{OUT}$ of the open/close solenoid valve 9 which is shown in FIG. 6 is carried out through steps generally indicated at 53.

Figure 7:
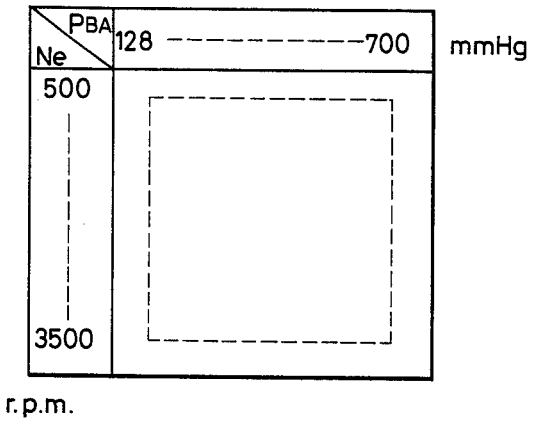
FIG. 7 is a diagram showing a data map which is previously stored in a ROM 30 of the control circuit 20.

In the A/F routine, whether or not operating states of the vehicle (including operating states of the engine) satisfy a condition for the feedback (F/B) control is detected at a step 531. This detection is performed according to various parameters, i.e., absolute pressure within the intake manifold, engine cooling water temperature, vehicle speed, and engine rotational speed. For instance, when the vehicle speed is low, or when the engine cooling water temperature is low, it is determined that the condition for the feedback control is not satisfied. If it is determined that the condition for the feedback control is not satisfied, the valve open period $T_{OUT}$ is made equal to "0" at a step 532 to stop the air-fuel ratio feedback control. On the other hand, if it is determined that the condition for the feedback control is satisfied, the supply of the secondary air within the period of one duty cycle $T_{SOL}$, i.e., a period of base duty ratio $D_{BASE}$ for the opening of the open/close solenoid valve 9, is set at a step 533. Various values of the period of base duty ratio $D_{BASE}$ which are determined according to the absolute pressure within the intake manifold $P_{BA}$ and the engine speed $N_e$ are previously stored in the ROM 30 in the form of a $D_{BASE}$ data map as shown in FIG. 7, and the CPU 29 firstly reads current values of the absolute pressure $P_{BA}$ and the engine speed $N_e$ and in turn searches a value of the period of base duty ratio $D_{BASE}$ corresponding to the read values from the $D_{BASE}$ date map in the ROM 30. Then, whether or not a count period of a time counter A incorporated in the CPU 29 (not shown) has reached a predetermined time period $\Delta t_1$ is detected at a step 534. This predetermined time period $\Delta t_1$ corresponds to a delay time from a time of the supply of the air intake side secondary air to a time in which a result of the supply of the air intake side secondary air is detected by the oxygen concentration sensor 14 as a change in the oxygen concentration of the exhaust gas. When the predetermined time period $\Delta t_1$ has passed after the time counter A is reset to start the counting of time, the counter is reset again, at a step 535, to start the counting of time from a predetermined initial value. In other words, a detection as to whether or not the predetermined time period $\Delta t_1$ has passed after the start of the counting of time from the initial value by the time counter A, i.e. the execution of the step 535, is performed at the step 534. After the start of the counting of the pre-determined time period $\Delta t_1$ by the time counter A in this way, a target air-fuel ratio which is leaner than the stoichiometric air-fuel ratio is set at a step 536. For the setting of the target air-fuel ratio, various values for a reference level Lref corresponding to the target air-fuel ratio which is determined according to the values of the absolute pressure within the intake manifold $P_{BA}$ and the engine speed $N_e$, as in the case of the $D_{BASE}$ data map, are previously stored in the ROM 30 as an A/F data map. Therefore, the CPU 29 searches a reference level Lref corresponding to the current values of the absolute pressure $P_{BA}$ and the engine speed $N_e$ from the A/F data map. Next, from the information of the oxygen concentration, whether or not the output signal level $LO_2$ of the oxygen concentration sensor 14 is greater than the reference level Lref determined at the step 536 is detected at a step 537. In other words, whether or not an air-fuel ratio of the mixture to be supplied to the engine 5 is leaner than the target air-fuel ratio is detected at the step 537. If $LO_2 > Lref$, it means that the air-fuel ratio of the mixture is leaner than the target air-fuel ratio, and a subtraction value $I_L$ is calculated at a step 538. The subtraction value $I_L$ is obtained by multiplication among a constant $K_1$, the engine speed $N_e$, and the absolute pressure $P_{BA}$, ($K_1 \cdot N_e \cdot P_{BA}$), and is dependent on the amount of the intake air of the engine 5. After the calculation of the subtraction value $I_L$, a correction value $I_{OUT}$ which is previously calculated by the execution of operation of the A/F routine is read out from a memory location al in the RAM 31. Subsequently, the subtraction value $I_L$ is subtracted from the correction value $I_{OUT}$, and a result is in turn written in the memory location al of the RAM 31 as a new correction value $I_{OUT}$, at a step 539. On the other hand, if $LO_2 \leqq Lref$ at the step 537, it means that the current air-fuel ratio of the mixture is richer than the target air-fuel ratio, and a summing value $I_R$ is calculated at a step 5310. The summing value $I_R$ is calculated by a multiplication among a constant value $K_2$ ($\neq K_1$), the engine speed $N_e$, and the absolute pressure $P_{BA}$ ($K_2 \cdot N_e \cdot P_{BA}$), and is dependent on the amount of the intake air of the engine 5. After the calculation of the summing value $I_R$, the correction value $I_{OUT}$ which is previously calculated by the execution of the A/F routine is read out from the memory location al of the RAM 31, and the summing value $I_R$ is added to the read out correction value $I_{OUT}$. A result of the summation is in turn stored in the memory location al of the RAM 31 as a new correction value $I_{OUT}$ at a step 5311. After the calculation of the correction value $I_{OUT}$ at the step 539 or the step 5311 in this way, the correction value $I_{OUT}$ and the period of basic duty ratio $D_{BASE}$ set at the step 533 are added together, and the result is used as the valve open period $T_{OUT}$ at a step 5312.

Subsequently, whether or not the valve open period $T_{OUT}$ is longer than a maximum limit of valve open period $T_{OUTH}$, is detected at a step 5313. The maximum limit of valve open period $T_{OUTH}$ is calculated by an equation $T_{OUTH} = D_{BASE} + K_3 \cdot I_{OUTH}$, where $K_3$ is a coefficient, and $I_{OUTH}$ is a first standard value obtained by multiplication among the engine speed $N_e$, the absolute pressure $P_{BA}$, and a coefficient $\alpha_1$, ($\alpha_1 \cdot N_e \cdot P_{BA}$). If $T_{OUT} > T_{OUTH}$, the output valve open period $T_{OUT}$ is made equal to the maximum limit of valve open period $T_{OUTH}$ at a step 5314, and the correction value $I_{OUT}$ is made equal to a first standard value $I_{OUTH}$ at a step 5315. If, on the other hand, $T_{OUT} \leqq T_{OUTH}$, whether or not the output valve open period $T_{OUT}$ is shorter than a minimum limit of valve open period $T_{OUTL}$ is detected at a step 5316. The minimum limit of valve open period $T_{OUTL}$ is calculated by an equation $T_{OUTL} = D_{BASE} + K_4 \cdot I_{OUTL}$, where $K_4$ is a coefficient, and $I_{OUTL}$ is a second standard value which is obtained by a multiplication among the engine speed $N_e$, the absolute pressure $P_{BA}$, and a coefficient $\alpha_2$, and changing its polarity ($-\alpha_2 \cdot N_e \cdot P_{BA}$). If $T_{OUT} < T_{OUTL}$, the output valve open period is made equal to the minimum limit of valve open period at a step 5317, and the correction value $I_{OUT}$ is made equal to the second standard value $I_{OUTL}$ at a step 5318. If, on the other hand, $T_{OUT} \geqq T_{OUTL}$, the output valve open period $T_{OUT}$ calculated at the step 5312 is maintained as it is.

Additionally, after the reset of the time counter A and the start of the counting from the initial value at the step 535, if it is detected that the predetermined time period $\Delta t_1$ has not yet passed at the step 534, the operation of the step 5312 is immediately executed. In this case, the correction value $I_{OUT}$ calculated by the A/F routine up to the previous cycle is read out.

After the completion of the A/F routine, a valve close period $T_{AF}$ is calculated by subtracting the valve open period $T_{OUT}$ from the period of one duty cycle $T_{SOL}$, at a step 54. Subsequently, a value corresponding to the valve close period $T_{AF}$ is set in a time counter B incorporated in the CPU 29 (not shown), and down counting of the time counter B is started at a step 55. Then whether or not the count value of the time counter B has reached a value "0" is detected at a step 56. If the count value of the time counter B has reached the value "0", a valve open drive command signal is supplied to the drive circuit 28 at a step 57. In accordance with this valve open drive command signal, the drive circuit 28 operates to open the open/close solenoid valve 9. The opening of the open/close solenoid valve 9 is continued until a time at which the operation of the step 51 is performed again. If, at the step 56, the count value of the time counter B has not reached the value "0", the step 56 is effected repeatedly.

Figure 8:
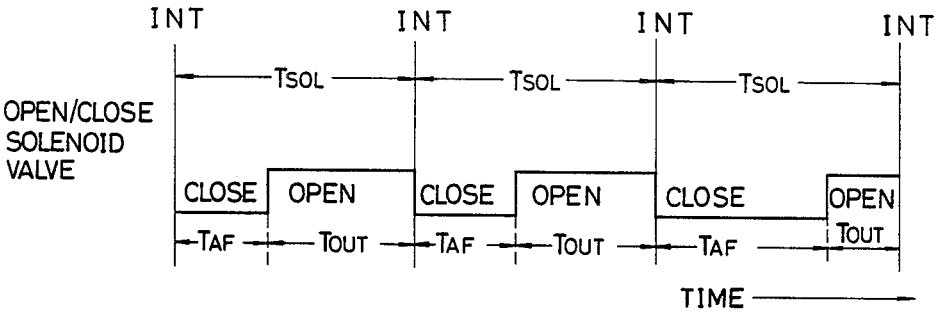
FIG. 8 is a timing chart showing the manner of operation of the system according to the invention generally shown in FIG. 1.

Thus, in the air intake side secondary air supply system according to the present invention, the open/close solenoid valve 9 is closed immediately in response to the generation of the internal interruption signal INT as illustrated in FIG. 8, to stop the supply of the air intake side secondary air to the engine 5. When the valve close time $T_{AF}$ for the open/close solenoid valve 9 within the period of one duty cycle is calculated and the valve close time $T_{AF}$ has passed after the generation of the interruption signal, the open/close solenoid valve 9 is opened to supply the air intake side secondary air to the engine through the air intake side secondary air supply passage 8. Thus, the duty ratio control of the supply of the air intake side secondary air is performed by repeatedly executing these operations. In this way, the air-fuel ratio of the mixture to be supplied to the engine is controlled toward the target air-fuel ratio by the duty ratio control of the supply of the air intake side secondary air. It is to be noted that the response characteristic against the command of the supply of the air intake side secondary air and the accuracy of the air-fuel ratio control are also very much improved. Further, the delay of the control response is compensated for by determining the base duty ratio $D_{BASE}$ in response to the operating condition of the engine.

It will be appreciated from the foregoing, according to the present invention, that the maximum limit of the valve open period $T_{OUTH}$ and the minimum limit of the valve open period $T_{OUTL}$ are set in response to operating parameters such as the engine speed $N_e$ and the absolute pressure of the intake air $P_{BA}$. Therefore, the accuracy of the air-fuel ratio control is improved. For instance, by setting the maximum limit of the valve open period $T_{OUTH}$ smaller in a low load state of the engine operation than in other states, the width of variation of the output valve open period $T_{OUT}$, i.e., the variation of the air-fuel ratio with respect to the base duty ratio $D_{BASE}$, can be reduced, to improve the follow-up characteristic of the air-fuel ratio toward the target air-fuel ratio.

Moreover, in the air intake side secondary air supply system according to the present invention, the air-fuel ratio is controlled to be leaner than the stoichiometric air-fuel ratio by using an $O_2$ sensor which has an output characteristic as shown in FIG. 3. Therefore, the fuel consumption characteristic is improved without sacrificing the driveability of the engine.

In the above explained embodiment, the time counter B was incorporated in the CPU 29. However, it is to be noted that the arrangements are not limited to this, and for instance, the time counter B can be provided outside the CPU 29 and the system can be constructed to provide a valve open drive command signal from the time counter B to the drive circuit 28 when the count value of the time counter B has reached "0". In addition, the first and second standard values $I_{OUTH}$, $I_{OUTL}$ were set to be different from each other in the above embodiment. However, the first and second standard values $I_{OUTH}$ and $I_{OUTL}$ can be set to be equal to each other, so long as their values are within or near an extent that the correction value $I_{OUT}$ may cover under the normal air-fuel ratio control operation toward the target air-fuel ratio.

Thus, in the air intake side secondary air supply system according to the present invention, the open/close valve is opened for the maximum limit of the valve open period within each duty period if the calculated output valve open period is longer than the maximum limit of the valve open period. Further, desirably, the correction value for the integration operation is made equal to the first standard value. On the other hand, if the calculated output valve open period is shorter than the minimum limit of the valve open period, the open/close valve is opened for the minimum limit of the valve open period within each duty period, and the correction value is desirably made equal to the second standard value. With this operation, the air-fuel ratio control operation is performed only using a range of the duty ratio in which the amount of the secondary air to be supplied to the engine is varied continuously. Since the duty ratio is not controlled to the value of 100%, the air-fuel ratio of the supplied mixture is prevented from becoming over-lean, thereby the deterioration of the driveability and misfire are prevented. Further, even in the event that the $O_2$ sensor fails, the duty ratio is prevented from being kept around the value of 0% or 100%. In other words, the open/close valve is prevented from being kept closed or opened, so that an abnormal state where the air-fuel ratio is widely deviated from the target air-fuel ratio is avoided.

Moreover, under such a condition that the calculated output valve open period is longer than the maximum limit of the valve open period or shorter than the minimum limit of the valve open period, it is very likely that the correction value is away from the range in which the correction value varies under the normal air-fuel ratio control operation. Therefore, by determining the correction value to be equal to the first or second standard value, it becomes possible to compensate for the delay of the integration control upon resumption of the normal air-fuel ratio control. In this way, the response characteristic of the air-fuel ratio control is improved.

What is claimed is:

1. An air intake side secondary air supply system for an internal combustion engine having an air intake passage with a carburetor and an exhaust passage, comprising:

an air intake side secondary air supply passage communicating with the air intake passage on the downstream side of the carburetor;

an open/close valve disposed in said air intake side secondary air supply passage;

an oxygen concentration sensor disposed in the exhaust passage and producing an output signal indicating an oxygen concentration in exhaust gas of the engine;

means for setting a target air-fuel ratio in response to engine operation; and control means for controlling a duty ratio of opening and closing of said open/close valve by comparing the output signal of the oxygen concentration sensor with a level corresponding to said target air-fuel ratio, calculating an output valve open period within each cyclic period of control operation in accordance with a result of said comparison subsequently, and opening said open/close valve for said output valve open period within each of said cyclic periods, said duty ratio control means being operative, when said calculated output valve open period becomes longer than a maximum limit of valve open period, to set said calculated output valve open period to be equal to said maximum limit, and to open said open/close valve for said output valve opening period within each of said cyclic periods and when said calculated output valve open period becomes shorter than a minimum limit valve open period, to set said calculated output valve open period to be equal to said minimum limit, and to open said open/close valve for said output valve open period within each of said cyclic periods.

2. An air intake side secondary air supply system as set forth in claim 1, wherein said maximum and minimum limits of valve open period are determined in response to parameters indicative of engine operation.

3. An air intake side secondary air supply system as set forth in claim 1, wherein said oxygen concentration sensor is adapted to produce the output signal whose level is generally proportional to the oxygen concentration in the exhaust gas at least when an air-fuel ratio of mixture supplied to the engine is on the lean side with respect to a stoichiometric air-fuel ratio.

4. An air intake side secondary air supply system for an internal combustion engine having an air intake passage with a carburetor and an exhaust passage, comprising:

an air intake side secondary air supply passage communicating with the air intake passage on the downstream side of the carburetor;

an open/close valve disposed in said air intake side secondary air supply passage;

an oxygen concentration sensor disposed in the exhaust passage and producing an output signal indicating an oxygen concentration in exhaust gas of the engine;

means for setting a target air-fuel ratio in response to engine operation; and control means for controlling a duty ratio of opening and closing of said open/close valve by comparing the output signal of the oxygen concentration sensor with a level corresponding to said target air-fuel ratio, determining a base valve open period in response to a plurality of parameters indicative of engine operation for each cyclic period of control operation, increasing or decreasing a correction value to be added to said base valve open period in accordance with a result of said comparison, and calculating an output valve open period within each of said cyclic periods by adding said correction value to said base valve open period, and opening said open/close valve for said output valve open period within each of said cyclic periods, said duty ratio control means being operative, when said calculated output valve open period becomes longer than a maximum limit of valve open period, to set said calculated output valve open period to be equal to said maximum limit, and to open said open/close valve for said calculated output valve opening period within each of said cyclic periods and setting said correction value at a first predetermined standard value, and, when said calculated output valve open period becomes shorter than a minimum limit of valve open period, to set said calculated output valve open period to be equal to said minimum limit, and to open said open/close valve for said output valve open period within each of said cyclic periods and setting said correction value at a second predetermined standard value.

5. An air intake side secondary air supply system as set forth in claim 4, wherein said first and second predetermined standard values are determined in response to parameters indicative of engine operation.

6. An air intake side secondary air supply system as set forth in claim 4, wherein said oxygen concentration sensor is adapted to produce the output signal whose level is generally proportional to the oxygen concentration in the exhaust gas at least when an air-fuel ratio of mixture supplied to the engine is on the lean side with respect to a stoichiometric air-fuel ratio.

* * * * *